US010047564B2

(12) United States Patent
Jones et al.

(10) Patent No.: US 10,047,564 B2
(45) Date of Patent: Aug. 14, 2018

(54) ROTARY PERCUSSIVE PILOTED ROCK DRILL BIT

(71) Applicant: Ajax Tool Works, Inc., Franklin Park, IL (US)

(72) Inventors: Michael T Jones, Lombard, IL (US); Robert J Benedict, Inverness, IL (US); Michael J Malget, Sleepy Hollow, IL (US)

(73) Assignee: Ajax Tool Works, Inc., Franklin Park, IL (US)

( * ) Notice: Subject to any disclaimer, the term of this patent is extended or adjusted under 35 U.S.C. 154(b) by 130 days.

(21) Appl. No.: 15/156,447

(22) Filed: May 17, 2016

(65) Prior Publication Data

US 2017/0335632 A1 Nov. 23, 2017

(51) Int. Cl.

| | |
|---|---|
| ***E21B 10/26*** | (2006.01) |
| ***E21B 10/40*** | (2006.01) |
| ***E21B 10/43*** | (2006.01) |

(52) U.S. Cl.

CPC ..... *E21B 10/40* (2013.01); *E21B 10/26* (2013.01); *E21B 10/43* (2013.01)

(58) Field of Classification Search

CPC ..... E21B 10/26; E21B 10/40; E21B 10/43
See application file for complete search history.

(56) References Cited

U.S. PATENT DOCUMENTS

| | | | | |
|---|---|---|---|---|
| 2,532,783 A | | 12/1950 | Phipps | |
| 2,578,593 A | | 12/1951 | Phipps | |
| 2,679,382 A | * | 5/1954 | Schmidt | E21B 10/003 175/400 |
| 2,818,292 A | | 12/1957 | Graber | |
| 2,938,709 A | | 5/1960 | Curtis | |

(Continued)

FOREIGN PATENT DOCUMENTS

| | | | | |
|---|---|---|---|---|
| DE | 10106695 B4 | | 11/2010 | |
| EP | 2799659 | * | 5/2014 | E21B 10/36 |
| GB | 660816 A | | 11/1951 | |

OTHER PUBLICATIONS

International Search Report in related PCT/US2017/032569.
Written Opinion of the International Search Authority in related PCT/US2017/032569.

*Primary Examiner* — D. Andrews
*Assistant Examiner* — Dany E Akakpo
(74) *Attorney, Agent, or Firm* — George Pappas

(57) ABSTRACT

A piloted rock drill bit includes an integral body having a pilot drill section, a reaming section and a mounting base section extending along a longitudinal axis. The reaming section includes four wings extending from the longitudinal axis in an "X" pattern. A cutting carbide member is secured to each wing. Waste debris ejection slots extend radially into the reaming section between the wings. The pilot drill section includes a post. A leading carbide member is secured to the post. The leading carbide member includes a pair of sloped surfaces extending forwardly towards each other and intersecting at a leading cutting edge which extends perpendicular to the longitudinal axis. The leading cutting edge and sloped surfaces extend along a crescent shaped arc. An air delivery bore extends through the body to discharge openings located between the leading cutting edge and wings which extend radially perpendicular to the leading cutting edge.

15 Claims, 4 Drawing Sheets

(56) References Cited

U.S. PATENT DOCUMENTS

| | | | |
|---|---|---|---|
| 3,145,789 | A | 8/1964 | Lawry |
| 3,469,641 | A | 9/1969 | Reynolds |
| 3,960,223 | A | 6/1976 | Kleine |
| 4,275,796 | A | 6/1981 | Kleine |
| 4,294,319 | A | 10/1981 | Guergen |

* cited by examiner

ROTARY PERCUSSIVE PILOTED ROCK DRILL BIT

BACKGROUND OF THE INVENTION

1. Field of the Invention

The present invention relates to the field of rock drill bits adapted to be mounted on and used with rotary percussive electric and/or pneumatic drills and hammers. More particularly, the present invention relates to a piloted rock drill bit having a central leading pilot drill point for drilling a pilot hole and lagging reaming wings for enlarging the pilot hole.

2. Background

Piloted rock drill bits, for example, as shown and described in U.S. Pat. No. 2,532,783; U.S. Pat. No. 2,818,292; U.S. Pat. No. 2,938,709; U.S. Pat. No. 3,145,789; U.S. Pat. No. 3,469,641; U.S. Pat. No. 4,275,796; and, U.S. Pat. No. 4,294,319, are known and are commonly used for drilling holes through hard materials such as concrete, stone, brick, masonry block, rock, etc. (herein collectively referred to as "rock"). These rock drill bits have a central leading pilot drill point for drilling a pilot hole and lagging reaming wings for enlarging the pilot hole. They are adapted to be mounted on rotary percussive drills and hammers (herein collectively referred to as "drills") which are electrically or pneumatically powered.

In use, the drills typically both rotate the drill bits about their longitudinal axis and, also, vibrate the drill bits along their longitudinal axis. After mounting on a drill, the rock drill bits are directed onto the rock and the rotary and vibratory/percussive action of the bit causes it to drill through/form a hole in the rock. The central leading drill point serves to form the pilot hole and, because the leading drill point projects into and is rotatably captured in the pilot hole, it also serves to guide the lagging reaming wings to concentrically enlarge the pilot hole to the desired size/diameter. The rock drill bits can be provided with central air passageways extending from the drill bit mounting base to openings at the lagging reaming wings. Accordingly, when the rock drill bits are mounted to pneumatic drills, pressurized air can be directed therethrough to the lagging reaming wings whereby rock swarf/waste debris resulting from the drilling (hereinafter referred to as "waste debris") can be blown out of the hole.

The prior piloted rock drill bits, however, have shortcomings and drawbacks. When starting a hole on a flat rock surface, they often skip therealong and are difficult to maintain centered at the desired hole location. Also, the waste debris often plugs the spaces between the reaming wings thereby requiring removal of the drill bit from the hole and cleaning. Moreover, the prior piloted rock drill bits are relatively difficult to manufacture and costly. Accordingly, a need exists for piloted rock drill bits which are relatively easy to maintain centered over the desired hole location when starting a hole, which minimize swarf/waste debris plugging and which are relatively easier to manufacture and less costly.

SUMMARY OF THE INVENTION

The present invention overcomes shortcomings and drawbacks of prior piloted rock drill bits by providing a piloted rock drill bit which is relatively easy to maintain centered over the desired hole location when starting a hole, minimizes waste debris plugging and is relatively easy to manufacture and relatively less costly.

In one form thereof the present invention is directed to a piloted rock drill bit having an integrally formed body including a leading pilot drill section, a central reaming wings section and a mounting base section successively arranged about and extending along a longitudinal axis between drill bit terminal forward and rear ends. The mounting base section includes a threaded bore adapted to threadingly engage and mount the rock drill bit onto a rotary percussive head of a drill. The central reaming wings section includes a plurality of wings extending radially from the longitudinal axis. Each of the wings have a wing pocket and a wing cutting carbide member secured in the wing pocket. The wing cutting carbide members project longitudinally in a direction towards the terminal forward end. The leading pilot drill section includes a post extending from the central reaming wings section towards the terminal forward end. The post includes a leading post pocket and a leading central carbide member secured in the leading post pocket. The leading central carbide member projects longitudinally beyond the post towards the terminal forward end.

Preferably, the leading central carbide member includes a pair of sloped cutting edge surfaces extending longitudinally forwardly towards each other and intersecting at a pilot drill leading cutting edge. The leading cutting edge extends generally perpendicular to the longitudinal axis. The sloped cutting edge surfaces and said pilot drill leading cutting edge preferably extend along a crescent shaped arc including a forwardly extending central section and lagging side sections. The leading post pocket is U-shaped and extends transversely between post opposing side surfaces and the leading central carbide member includes a correspondingly shaped body adapted to be received and secured in the U-shaped pocket.

Also preferably, the central reaming wings section includes four wings extending radially from the longitudinal axis in an "X" pattern. Each wing includes an outer curvilinear surface. Four waste debris ejection slots are provided. Each ejection slot is juxtaposed between a pair of wings and extends radially into the central reaming wings section from the outer curvilinear surfaces. The waste debris ejection slot preferably each include a frusto conical section and a cylindrical section. The frusto conical section is located forwardly of the cylindrical section.

The wings are preferably located radially perpendicular or parallel with the leading cutting edge. An air delivery bore extends through the rock drill bit and terminates at an air discharge opening extending through the leading pilot drill section post. The air discharge opening is located between the leading cutting edge and a wing located perpendicular to the leading cutting edge. Each of the wing cutting carbide members includes a pair of sloped cutting surfaces extending towards each other and intersecting at a leading cutting edge. The sloped cutting surfaces and the leading cutting edge project forwardly and are generally perpendicular to the longitudinal axis.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
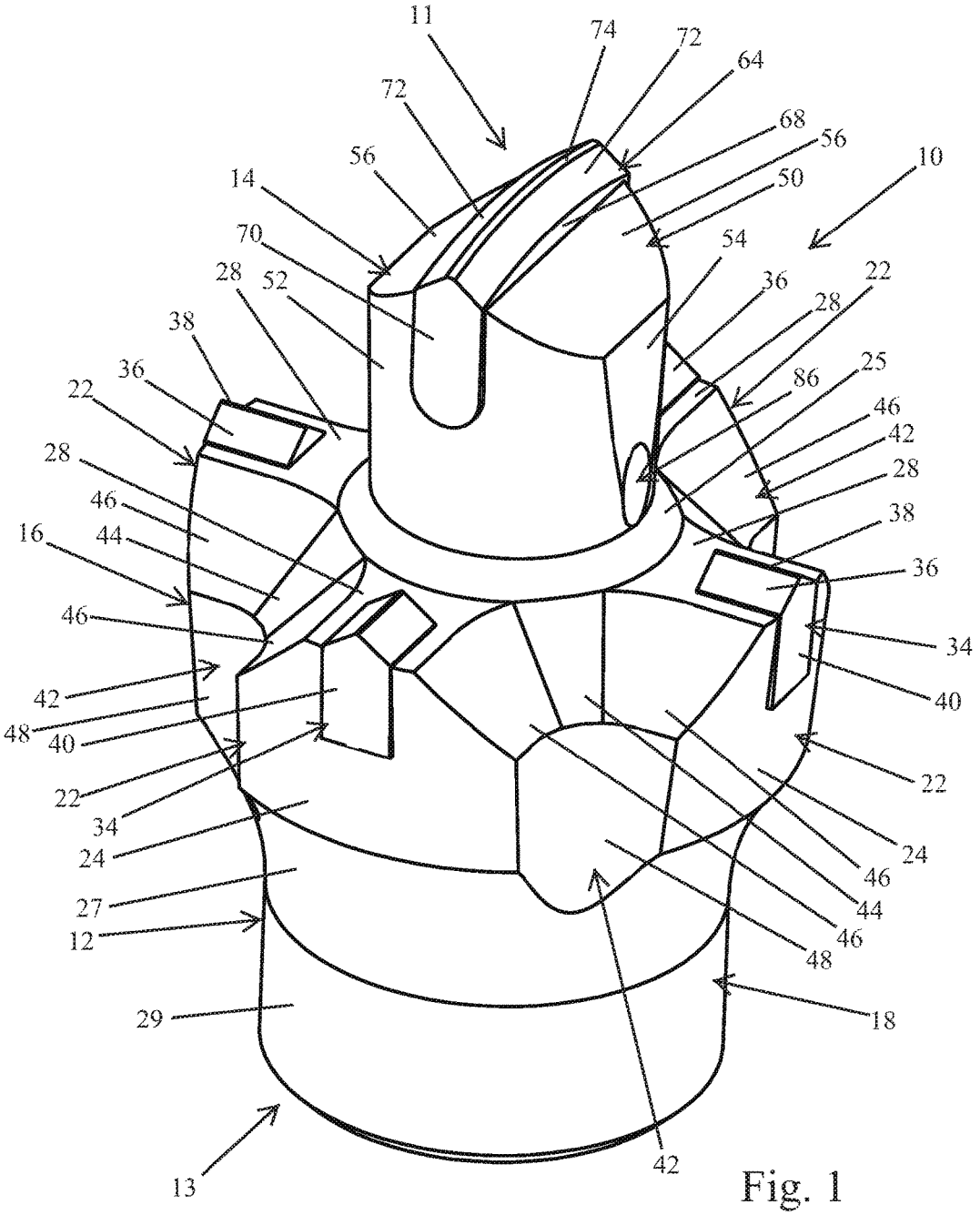
FIG. 1 is a perspective view of a piloted rock drill bit constructed in accordance with the principles of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

A piloted rock drill bit constructed in accordance with the principles of the present invention is shown and generally designated in the drawings with the numeral 10. Piloted rock drill bit 10 includes an integrally formed steel body 12 which is formed by casting and/or forging. Body 12 includes a leading pilot drill section 14, a central reaming wings section 16 and a mounting base section 18 which are integrally formed to one another. The body sections 14, 16, 18 are successively arranged concentrically about the longitudinal axis 20 between the drill bit terminal forward/leading end 11 and the drill bit terminal rear/lagging end 13.

Figure 4:
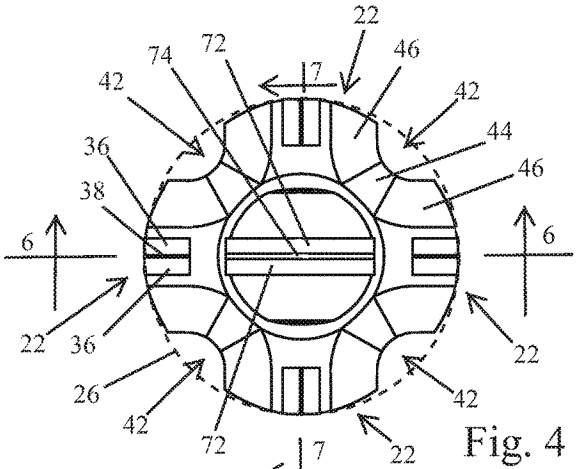
FIG. 4 is a top plan view of the piloted rock drill bit shown in FIG. 1.
Figure 3:
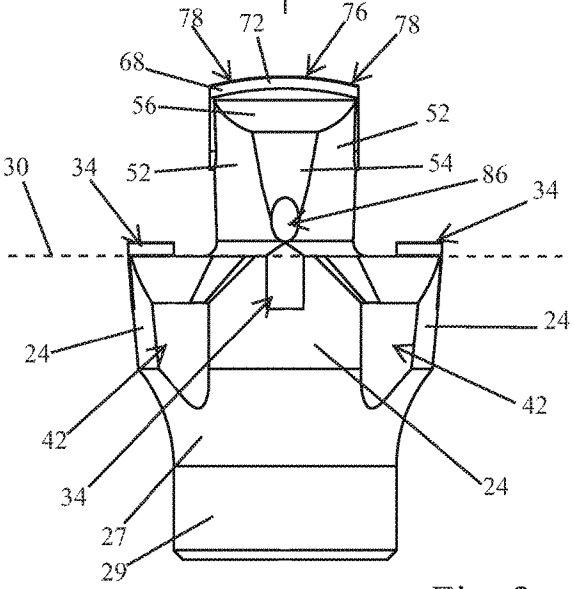
FIG. 3 is a side elevation view of the piloted rock drill bit shown in FIG. 1.

The central reaming section 16 includes four (4) wings 22, each of which extend radially from the longitudinal axis 20 and terminate at a respective outer curvilinear surface 24. Each of the wing outer curvilinear surfaces 24 extend along an imaginary cylindrical surface depicted in FIG. 4 with a dash line 26. The wings 22 are located in an "X" pattern, essentially at right angles from each other about the longitudinal axis 20. Each wing 22 includes a respective leading surface 28. The leading surfaces 28 are coplanar with one another and with an imaginary plane depicted in FIG. 3 with a dash line 30. Imaginary plane 30 is perpendicular to the longitudinal axis 20. It is noted that each wing leading surface 28 extends radially between a respective outer curvilinear surface 24 and the ring shaped surface 25 which is located between the leading pilot drill section 14 and the central reaming wings section 16. Also, each outer curvilinear surface 24 extends longitudinally between a respective leading surface 28 and the conical base surface 27 which extends between the central reaming wings section 16 and the base section 18. Conical base surface 27 tapers into the cylindrical surface 29 of the base section 18.

Pockets 32 are formed in each respective wing 22. The pockets 32 extend into their respective wing 22 from their respective wing outer curvilinear surface 24 and their respective wing leading surface 28. Pockets 32 are generally rectangular shaped and are adapted to receive a wing cutting carbide member 34. Carbide members 34 each include a correspondingly shaped rectangular body adapted/sized to be received in and brazed or otherwise secured in a respective pocket 32. The carbide members 34 each include a pair of sloped cutting surfaces 36 extending centrally towards each other and intersecting at a leading cutting edge 38. The sloped cutting surfaces 36 and leading cutting edges 38 are hence located longitudinally above the wing leading surfaces 28 and project forwardly generally towards/in the direction of the leading pilot drill section 14. The cutting surfaces 36 and the leading cutting edges 38 are generally perpendicular to the longitudinal axis 20. The carbide members 34 also include an outer surface 40 extending generally along, but projecting radially slightly beyond, their respective wing curvilinear surface 24. Of course, the radial length of the wing pockets 32 and, hence, the corresponding radial length of the wing cutting carbide members 34 can be varied for increasing or decreasing the effective radial length of their cutting surfaces 36 and leading cutting edges 38.

Waste debris ejection slots 42 are formed between each of the reaming section wings 22 and extend radially inwardly from the outer curvilinear surfaces 24. The ejections slots 42, similar to the wings 22, are located in an "X" pattern, essentially at a right angle from each other about the longitudinal axis 20 and juxtaposed between the wings 22. The ejection slots 42 include a frusto conical shaped section formed with adjacent sloped central surfaces 44 and sloped side surfaces 46. The ejection slots 42 also include a cylindrical section formed with a cylindrical surface 48. Each of the sloped central surfaces 44 extend at a slope between the central ring surface 25 and the cylindrical surface 48. Each of the side surfaces 46 similarly extend at a slope between a wing leading surface 28 and a cylindrical surface 48. Each of the cylindrical surfaces 48 extend longitudinally, perpendicular to the longitudinal axis 20, between the central and side surfaces 44, 46 and the conical base surface 27.

The leading pilot drill section 14 includes a central post 50 extending longitudinally forward of the central reaming wings section 16 and collinear with the longitudinal axis 20. Central post 50 is defined by cylindrical surfaces 52, longitudinal flats 54 located circumferentially between the cylindrical surfaces 52, and sloped surfaces 56 extending forwardly beyond the longitudinal flats 54 and along a forward leading edge of the cylindrical surfaces 52. Both the cylindrical surfaces 52 and flats 54 hence extend longitudinally between the ring shaped surface 25 and the sloped surfaces 56.

A U-shaped pocket 58 if formed into the central post 50 extending longitudinally therein from the sloped surfaces 56 and transversly between the opposing cylindrical side surfaces 52. U-shaped pocket 50 preferably has a cylindrical shaped bottom/rear surface 60 extending between pocket side walls 62. The pocket side walls 62 extend from the bottom/rear surface 60 longitudinally forwardly to the leading edge of the respective sloped surfaces 56.

A leading central carbide member 64 includes a correspondingly shaped body adapted/sized to be received in and brazed or otherwise secured in the U-shaped pocket 58. More particularly, carbide member 64 includes a cylindrical shaped bottom surface 66 adapted to seat against the pocket cylindrical shaped bottom/rear surface 60, and side walls 68 adapted to seat against the pocket side walls 62. The carbide member bottom surface 66 and side walls 68 extend transversely, preferably projecting slightly beyond the central post cylindrical surfaces 52, and terminating at the carbide member end walls 70.

The leading carbide member 64 further includes a pair of sloped cutting edge surfaces 72 extending longitudinally forwardly from the side walls 68 towards each other and intersecting at a pilot drill leading cutting edge 74. The sloped cutting edge surfaces 72 are located longitudinally forward beyond and leading the central post sloped surfaces 56. The sloped cutting edge surfaces 72 and hence also the pilot drill leading cutting edge 74 extend along a crescent shaped arc which, as best seen if FIGS. 3 and 6, includes a forwardly extending central section 76 and lagging side sections 78. It has advantageously been found that, when starting a pilot hole on a flat rock surface, the crescent shaped cutting edge surface 72 minimizes skipping and, therefore, the drill bit 10 is more easily maintained centered at the desired hole location, thereby also more quickly starting the pilot hole.

Figure 2:
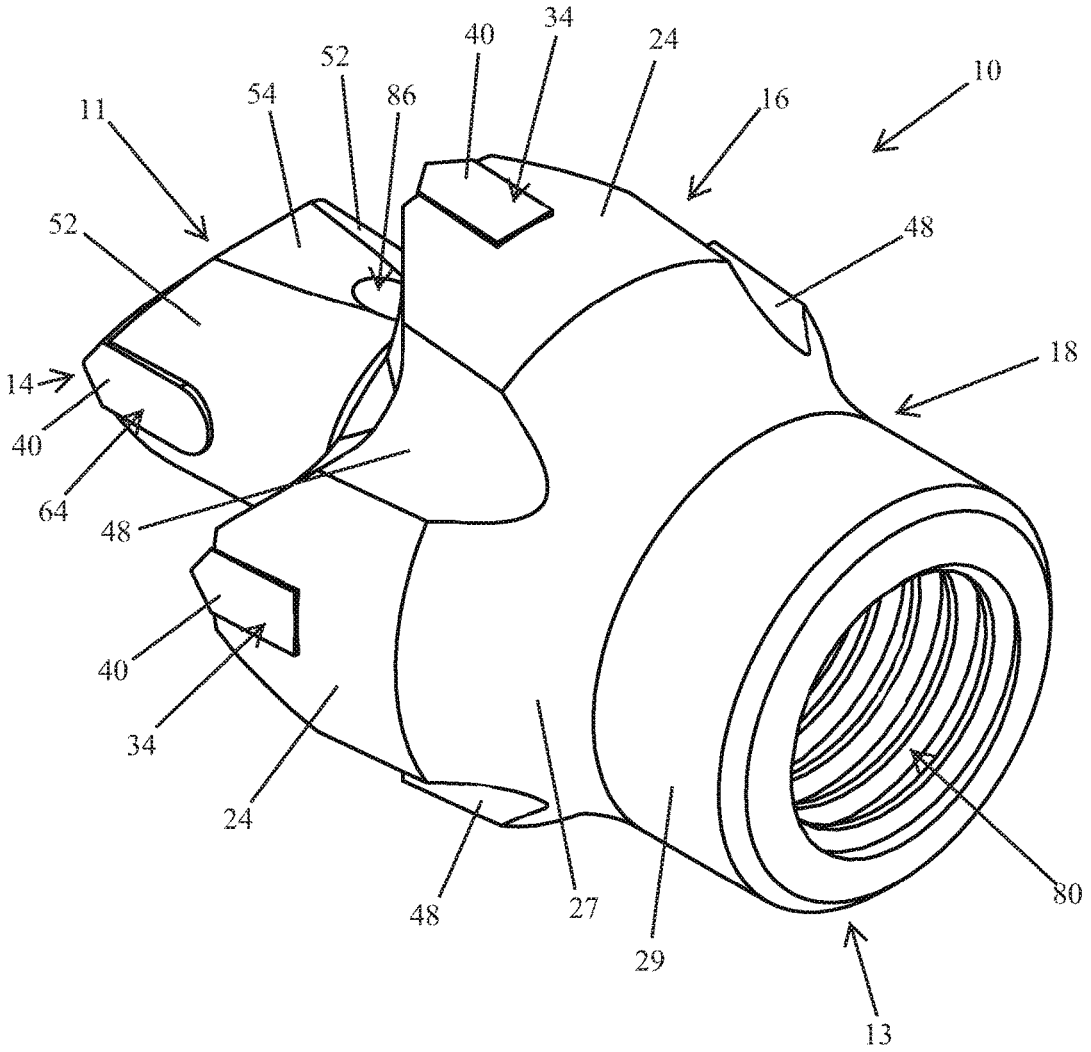
FIG. 2 is another perspective view of the piloted rock drill bit shown in FIG. 1.
Figure 5:
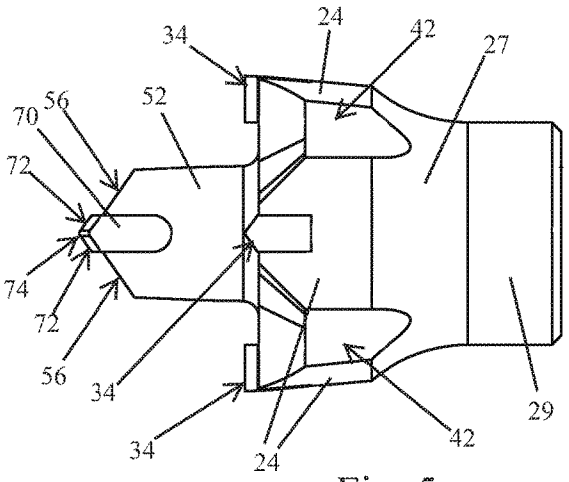
FIG. 5 is a side elevation view of the piloted rock drill bit shown in FIG. 1 but from an angle orthogonal to the view of FIG. 3.
Figure 7:
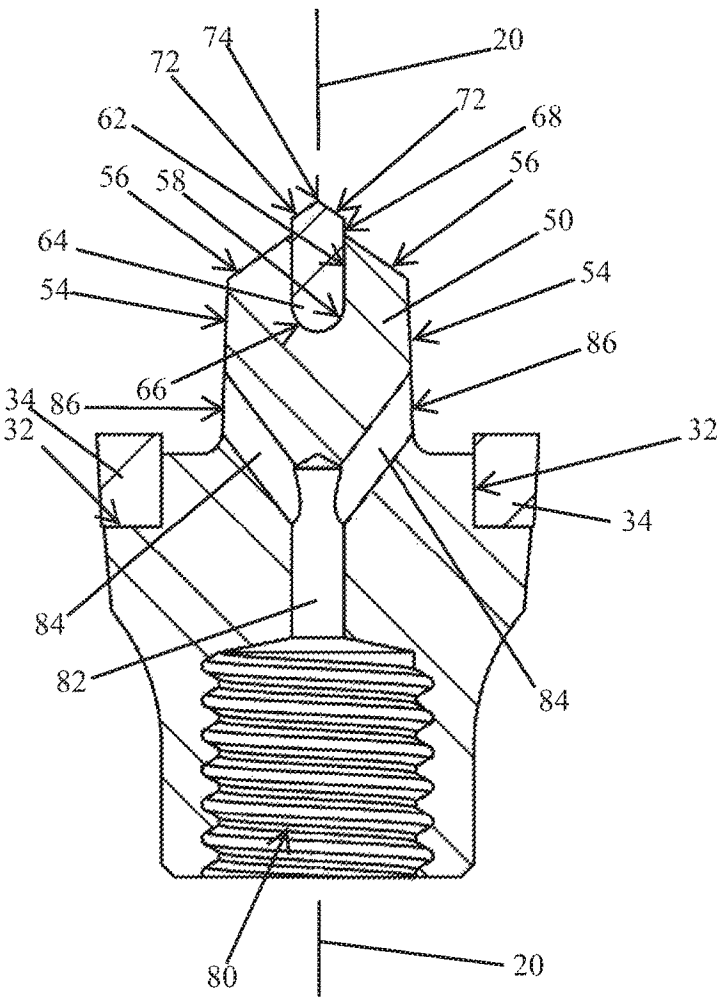
Figure 6:
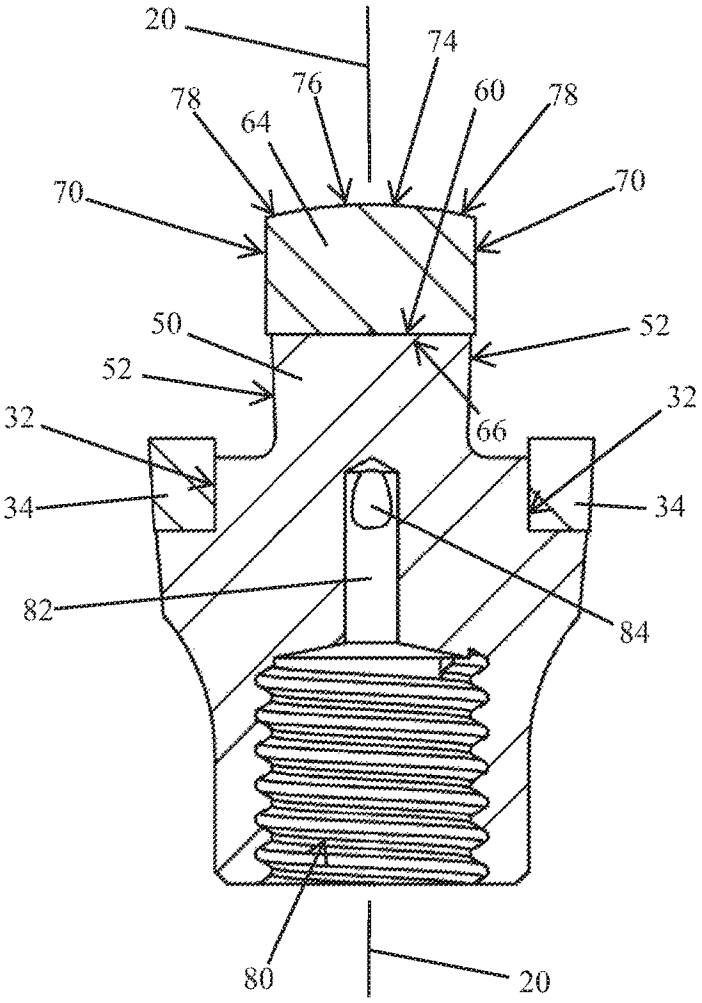
FIG. 6 is a cross sectional view of the piloted rock drill as shown in FIG. 4 and taken along line 6-6; and, FIG. 7 is a cross sectional view of the piloted rock drill as shown in FIG. 4 and taken along line 7-7.

The mounting base section 18, as best seen in FIGS. 2, 6 and 7, includes a threaded bore 80 adapted to threadingly engage a rotary percussive head of a drill (not shown) in a known and customary manner. Threaded bore 80 communicates with a central air delivery bore 82 which is adapted to receive pressurized air from a drill head, also in a known and customary manner. Air delivery bore 82 extends longitudinally through the central reaming section 16 and communicates with branch air deliver bores 84 which extend to air discharge openings 86 located at the base of the longitudinal flats 54 of the central post 50. The discharge openings 86 are hence located longitudinally forward of the central reaming wings section 16. Additionally, as best seen in FIGS. 1 and 7, the longitudinal flats 54 and discharge openings 86 are radially aligned with a pair of radially opposed reaming section wings 22 and wing cutting carbide members 34.

In operation, when the rock drill bit 10 is mounted to a pneumatic drill, pressurized air is directed therethrough to the central air delivery bore 80, through the branch delivery bores 84 and out through the discharge openings 86. It has been advantageously found that, by locating the discharge openings 86 as shown and described, waste debris is more effectively blown out of the hole being drilled through the waste debris ejection slots 42 and the inner surface of the drilled hole. It has also advantageously been found that, by locating the discharge openings 86 as shown and described, waste debris plugging at the ejection slots 42 occurs less often and/or not at all.

It has yet further been found that the rock drill bit 10 manufactured as shown and described is relatively easier and less costly to manufacture while performing exceptionally well in starting and drilling holes in rock.

While this invention has been described as having an exemplary design, the present invention may be further modified within the spirit and scope of this disclosure. This application is therefore intended to cover any variations, uses, or adaptations of the invention using its general principles.

What is claimed is:

1. A piloted rock drill bit comprising:

a drill bit body including a leading pilot drill section, a central reaming wings section and a mounting base section successively arranged about and extending along a longitudinal axis between drill bit terminal forward and rear ends;

wherein said leading pilot drill section, central reaming wings section and mounting base section are integrally formed together and form said drill bit body;

said mounting base section including a threaded bore adapted to threadingly engage and mount said rock drill bit onto a rotary percussive head of a drill;

said central reaming wings section including a plurality of wings extending radially from said longitudinal axis;

each of said wings having a wing pocket and a wing cutting carbide member secured in said wing pocket, said wing cutting carbide members projecting longitudinally in a direction towards said terminal forward end;

said leading pilot drill section including a post extending from said central reaming wings section towards said terminal forward end;

said post consisting of a leading post pocket and a leading central carbide member secured in said leading post pocket, said leading central carbide member projecting longitudinally beyond said post towards said terminal forward end;

wherein said leading central carbide member includes a pair of sloped cutting edge surfaces extending longitudinally forwardly towards each other and intersecting at a pilot drill leading cutting edge, said leading cutting edge extending generally perpendicular to said longitudinal axis; and, wherein said sloped cutting edge surfaces and said pilot drill leading cutting edge extend along a crescent shaped arc including a forwardly extending central section and lagging side sections.

2. The piloted rock drill bit of claim 1 wherein said leading post pocket is U-shaped and extends transversely between post opposing side surfaces, and wherein said leading central carbide member includes a correspondingly shaped body adapted to be received and secured in said U-shaped pocket.

3. The piloted rock drill bit of claim 1 wherein said central reaming wings section includes four wings extending radially from said longitudinal axis in an "X" pattern, each wing including an outer curvilinear surface, and wherein four waste debris ejection slots are provided, each ejection slot juxtaposed between a pair of wings and extending radially into said central reaming wings section from said outer curvilinear surfaces.

4. The piloted rock drill bit of claim 3 wherein each said waste debris ejection slot includes a frusto conical section and a cylindrical section, and wherein said frusto conical section is located forwardly of said cylindrical section.

5. The piloted rock drill bit of claim 4 wherein said wings are located radially perpendicular or parallel with said leading cutting edge.

6. The piloted rock drill bit of claim 5 further comprising an air delivery bore extending through said rock drill bit and terminating at an air discharge opening extending through said leading pilot drill section post, said air discharge opening located between said leading cutting edge and a wing located perpendicular to said leading cutting edge.

7. The piloted rock drill bit of claim 1 wherein said central reaming wings section includes four wings extending radially from said longitudinal axis in an "X" pattern, each wing including an outer curvilinear surface, and wherein four waste debris ejection slots are provided, each ejection slot juxtaposed between a pair of wings and extending radially into said central reaming wings section from said outer curvilinear surfaces.

8. The piloted rock drill bit of claim 7 wherein each said waste debris ejection slot includes a frusto conical section and a cylindrical section and wherein said frusto conical section is located forwardly of said cylindrical section.

9. The piloted rock drill bit of claim 8 wherein said wings are located radially perpendicular or parallel with said leading cutting edge.

10. The piloted rock drill bit of claim 9 further comprising an air delivery bore extending through said rock drill bit and terminating at an air discharge opening extending through said leading pilot drill section post, said air discharge opening located between said leading cutting edge and a wing located perpendicular to said leading cutting edge.

11. The piloted rock drill bit of claim 10 wherein each said wing cutting carbide member includes a pair of sloped cutting surfaces extending towards each other and intersecting a leading cutting edge, said sloped cutting surfaces and said leading cutting edge projecting forwardly, and wherein said leading cutting edge is generally perpendicular to said longitudinal axis.

12. The piloted rock drill bit of claim 1 wherein each said wing cutting carbide member includes a pair of sloped cutting surfaces extending towards each other and intersecting a leading cutting edge, said sloped cutting surfaces and said leading cutting edge projecting forwardly, and wherein said leading cutting edge is generally perpendicular to said longitudinal axis.

13. The piloted rock drill bit of claim 1 wherein said wings are located radially perpendicular or parallel with said leading cutting edge.

14. The piloted rock drill bit of claim 13 further comprising an air delivery bore extending through said rock drill bit and terminating at an air discharge opening extending through said leading pilot drill section post, said air discharge opening located between said leading cutting edge and a wing located perpendicular to said leading cutting edge.

15. The piloted rock drill bit of claim 14 wherein each said wing cutting carbide member includes a pair of sloped cutting surfaces extending towards each other and intersecting t a leading cutting edge, said sloped cutting surfaces and said leading cutting edge projecting forwardly, and wherein said leading cutting edge is generally perpendicular to said longitudinal axis.

* * * * *